US009283607B2

(12) United States Patent
Schulz et al.

(10) Patent No.: US 9,283,607 B2
(45) Date of Patent: Mar. 15, 2016

(54) DEVICE FOR CORRUGATING A PIPE CONSISTING OF METAL

(75) Inventors: Holger Schulz, Hannover (DE); Ralf Egerer, Seesen (DE)

(73) Assignee: NEXANS, Paris (FR)

( * ) Notice: Subject to any disclaimer, the term of this patent is extended or adjusted under 35 U.S.C. 154(b) by 510 days.

(21) Appl. No.: 13/586,315

(22) Filed: Aug. 15, 2012

(65) Prior Publication Data

US 2013/0205858 A1 Aug. 15, 2013

(30) Foreign Application Priority Data

Sep. 12, 2011 (EP) ..... 11290404

(51) Int. Cl.

| | |
|---|---|
| ***B21D 15/00*** | (2006.01) |
| ***B21D 15/04*** | (2006.01) |
| ***B21D 15/06*** | (2006.01) |
| *B21D 15/12* | (2006.01) |

(52) U.S. Cl.

CPC ..... *B21D 15/00* (2013.01); *B21D 15/04* (2013.01); *B21D 15/06* (2013.01); *B21D 15/12* (2013.01)

(58) Field of Classification Search

CPC ..... B21D 15/00; B21D 15/02; B21D 15/04; B21C 37/20; B21C 37/207

USPC ..... 72/370.19, 370.2, 1–5, 6.1, 16.1, 16.4, 72/16.7, 16.8, 20.1, 20.2, 20.3, 20.4, 20.5, 72/21.4, 21.6, 28.1, 29.2, 30.1, 31.01, 72/31.06, 48–52, 66, 67–126, 404, 72/405.01–405.06, 407, 408, 429, 462, 72/465.1, 467, 468

See application file for complete search history.

(56) References Cited

U.S. PATENT DOCUMENTS

| | | | | |
|---|---|---|---|---|
| 3,874,211 | A * | 4/1975 | Hayashi | 72/208 |
| 4,061,008 | A * | 12/1977 | Semenenko | 72/98 |
| 4,766,753 | A * | 8/1988 | Berstein et al. | 72/110 |
| 5,325,693 | A * | 7/1994 | Hoffmann et al. | 72/14.4 |
| 2009/0217724 | A1 * | 9/2009 | Bosga et al. | 72/29.2 |

FOREIGN PATENT DOCUMENTS

| | | |
|---|---|---|
| EP | 1084774 | 3/2001 |
| JP | 60133931 | 7/1985 |

* cited by examiner

*Primary Examiner* — Alexander P Taousakis
*Assistant Examiner* — Pradeep C Battula
(74) *Attorney, Agent, or Firm* — Sofer & Haroun, LLP

(57) ABSTRACT

A device for corrugating a metal pipe having a corrugation extending transversely of its longitudinal direction. The device has a ring-shaped corrugating head drivable by a first electric motor and is rotatable about its axis in the operating position and a ring-shaped corrugation disc, coupled to the ring-shaped corrugating head, projects radially inwardly from the corrugation head. The corrugation disc is mounted in the corrugation head so as to be adjustable in the radial direction. A support, coupled to the corrugation head, is arranged so as to also be rotatable about the axis of the corrugation head. An adjusting mechanism acting on the corrugation disc is mounted on the corrugation head. The adjusting mechanism serves for radially adjusting the corrugation disc and is adjustable by the support. The support is connected to a second electric motor serving for rotating the support about the axis (A) of the corrugation head.

4 Claims, 2 Drawing Sheets

DEVICE FOR CORRUGATING A PIPE CONSISTING OF METAL

RELATED APPLICATION

This applications claims the benefit of priority from European. Patent Application No. 11 290 404.0, filed no Sep. 12, 2011, the entirety of which is incorporated by reference.

BACKGROUND

1. Field of the Invention

The invention relates to a device for corrugating a pipe consisting of metal which, as a finished product, has an corrugation extending transversely of its longitudinal direction, wherein the corrugation includes a ring-shaped corrugation head which can be driven by a first electric motor and which is rotatable about its axis in an operating position, wherein an annular corrugation disc is coupled to the corrugation head, wherein the corrugation disc is mounted in the corrugation head so as to be adjustable in the radial direction and projects inwardly from the corrugation head wherein, in the area of the corrugation head, a support is arranged which is also rotatable around the axis of the corrugation head and is coupled to the corrugation head, and wherein an adjusting mechanism acting on the corrugation disc and serving for the radial adjustment thereof is mounted on the support (JP 60133931 A).

2. Description of the Related Art

Pipes of this type are easily bendable because of the corrugation, on the one hand, and are stable relative to forces acting on the pipes in the radial direction, on the other hand. They can be used for conveying fluid media, however, they can also be used as casings or conductors for electrical and/or optical cables. For example, a respective pipe used as casing may consist of steel. Advantageously, it is used in high frequency cables. In that case, it consists preferably of copper.

The known device according to EP 1 084 774 B1 includes a corrugation head rotatable about an initially smooth pipe, wherein the corrugation head includes a corrugation disc mounted eccentrically relative to the pipe, wherein during operation of the device, the corrugation disc presses a corrugation into the pipe. Mounted on the corrugation head is a hollow shaft which protrudes from the corrugation head in the withdrawal direction thereof, wherein after the corrugating process the pipe is pulled through the hollow shaft and wherein the hollow shaft is rotatable about its axis by an electric motor together with the corrugation head. During operation of the device, the hollow shaft takes along with it the corrugation head which is fixedly connected to the hollow shaft, wherein the corrugation disc presses the corrugation continuously into the pipe which is moved through the, corrugation head in its axial direction. The corrugation head with connected hollow shaft, as well as the rotor of the electric motor fastened to the hollow shaft, are combined in this known device into a unit which is mounted so as to be movable in the axial direction. As a result, tolerances which could influence the corrugation processes, and could occur during the continuous manufacture, can be compensated. The shape of the corrugation, particularly the depth of the corrugations, is measured, for example, when starting up the device. If this shape deviates from the predetermined dimensions, the corrugation disc must be readjusted. For this purpose, the device has to be stopped and then restarted after the adjustment process.

The above-mentioned JP 60133931 A describes a device for corrugating a pipe consisting of metal, which, as the finished product, has a corrugation extending transversely of its longitudinal direction. It has a ring-shaped corrugation head which is driven by an electric motor and is rotatable about its axis in its position of operation, wherein a ring-shaped corrugation disc is coupled to the corrugation head, wherein the corrugation disc projects radially inwardly from the corrugation head, and wherein the corrugation disc is mounted in the corrugation head so as to be adjustable in the radial direction. In the area of the corrugation head, a support coupled to the corrugation head is arranged so as to be rotatable about the axis of the corrugation head. For adjusting the corrugation disc in its radial adjustment, a differential gear unit is arranged between the electric motor and the support. Its different gear wheels are mounted in a basket. The differential gear unit makes it possible that the support rotates during operation with the same rate of rotation as the corrugation head. A hand wheel acts on the basket of the differential gear unit. The rate of rotation of the support can be changed by briefly switching on the basket. This leads to a radial adjustment of the corrugation disc.

OBJECTS AND SUMMARY

It is the object of the invention to configure the above-described device in such a way that the shape of the corrugation of the pipe can be changed even during the operation.

In accordance with the invention, the above object is net by connecting the support to a second electric motor which serves for rotating the support about the axis of the corrugation head.

Therefore, it is possible to radially adjust the corrugation disc during running production. Accordingly, it is possible to extremely precisely adjust the corrugation depth of the pipe to be corrugated, without having to stop the device. This has an advantageous effect, especially when starting up the device, because the desired corrugation depth can be adjusted very quickly without interrupting the operation. Consequently, initial lengths produced as scrap can be kept very short.

However, with this device, the corrugation can also be produced variably. For example, the corrugation depth can be changed during ongoing production. It is also possible to manufacture pipes which have sections without corrugation which are connected to each other through corrugated sections in which the pipe can be bent easily.

The second electric motor, arranged between the first electric motor and the support, serves for changing or adjusting the corrugation of the pipe, wherein the second electric motor then rotates the support with the same rate of rotation at which the corrugation head is also rotated, if no changes have to be made to the corrugation disc. As necessary, the rate of rotation of the second electric motor is changed briefly, so that also the rate of rotation of the support is changed. As a result, this also adjusts the corrugation disc in a simple manner and with few individual parts in the radial direction in the desired manner.

BRIEF DESCRIPTION OF THE DRAWINGS

An embodiment of the subject matter of the invention is illustrated in the drawings.

In the drawing.

DETAILED DESCRIPTION

Figure 1:
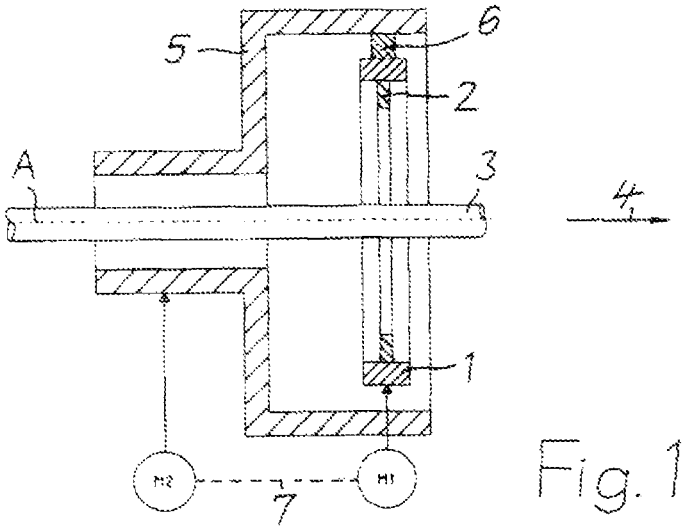
FIG. 1 shows a device according to the invention in a schematic illustration.

The device according to the invention is purely schematically illustrated in FIG. 1.

FIG. 1 serves merely for explaining the principal construction and manner of operation of the device. More precise details can be seen in FIGS. 2 and 3.

A ring-shaped corrugation head 1 is shown in FIG. 1 which is rotatable about its axis and for this purpose is driven by a first electric motor M1—in the following called "motor M1" for short. Mounted in the corrugation head 1 is an also ring-shaped corrugation disc 2 which protrudes radially inwardly from the corrugation head 1, and which preferably consists of high-grade steel. The corrugation disc 2 is adjustable within the corrugation head 1 in the radial direction and serves for pressing corrugation valleys into a pipe 3 consisting of metal which is pulled, for example, in the direction of arrow 4 through the corrugation head 1. The corrugation disc 2 is mounted eccentrically in the corrugation head 1. During operation of the device, the corrugation disc 2 rolls in the circumferential direction around the pipe 3 or on the pipe 3. The pipe 3 can be, for example, of copper or aluminum or alloys of these materials, or of steel, particularly high-grade steel.

The corrugation disc 2 can be constructed as a smooth annular disc for producing a helical corrugation in pipe 3. However, it may also extend along a helical path for producing a ring-shaped corrugation.

A support 5 is mounted in the area of the corrugation head 1, wherein the support 5 is rotatable together with the corrugation head 1 around the axis A. In accordance with FIG. 1, the support is driven by a second electric motor M2—in the following called "motor 2" for short. An adjusting mechanism 6 is mounted on the support 5; the adjusting mechanism 6 acts on the corrugation disc 2 and, as necessary, adjusts the corrugation disc 2 in the radial direction within the corrugation head 1. For such an adjustment, the rate of rotation of the motor M2 is briefly changed, so that the rate of rotation of the support 5 is also changed. The resulting changed position of the adjustment mechanism is dependent, for example, on the rate of rotation of the support 5.

The device according to FIG. 1 is operated, for example, as follows:

Initially, a smooth pipe 3 of metal is pulled through the corrugation head 1 and, thus, through the corrugation disc 2 which during this procedure is adjusted in such a way that it does not contact the pipe 3. The pipe 3 is connected with a take-off device, not illustrated for simplicity's sake, for example, a caterpillar take-off, and is pulled by the caterpillar take-off during operation through the corrugation head 1 in the direction of or against the direction of the arrow 4.

Subsequently, the corrugation disc 2, which is arranged so as to be eccentric relative to the pipe 3 or the axis A, is moved toward the pipe 3 until it makes contact with the surface of the pipe at a location of its circumference. Next, the motors M1 and M2, as well as the caterpillar take-off for the pipe 3, are switched on. The motor M1 rotates the corrugation head 1 with the corrugation disc 2 about the pipe 3 which is moved by the take-off device in the direction of arrow 4 (or against the direction of arrow 4). The depth of the corrugation or the corrugation valleys is measured by a controlling unit or also manually. By means of the motor M2, the support 5 is rotated about the axis A at the same speed as the corrugation head 1. In order to make this possible in a simple manner, the two motors M1 and M2 can be connected to each other in the manner of an electrical shaft. This is indicated by the broken line 7.

The depth of the corrugation is measured immediately after the beginning of the operation of the device. This can be effected by, for example, an optical and/or electrical unit by means of which the corrugation disc 2 is automatically adjusted in the compensating sense by a regulating circuit connected to the adjusting mechanism 6. For adjusting the corrugation disc 2, the rate of rotation of the motor M2 is temporarily increased or decreased by a signal of the monitoring unit. The rate of rotation of the support 5 is then changed by the motor M2. The adjusting mechanism 6, coupled to the support 5, adjusts the corrugation disc 2 until the depth of the corrugation corresponds to the predetermined value.

Figure 2:
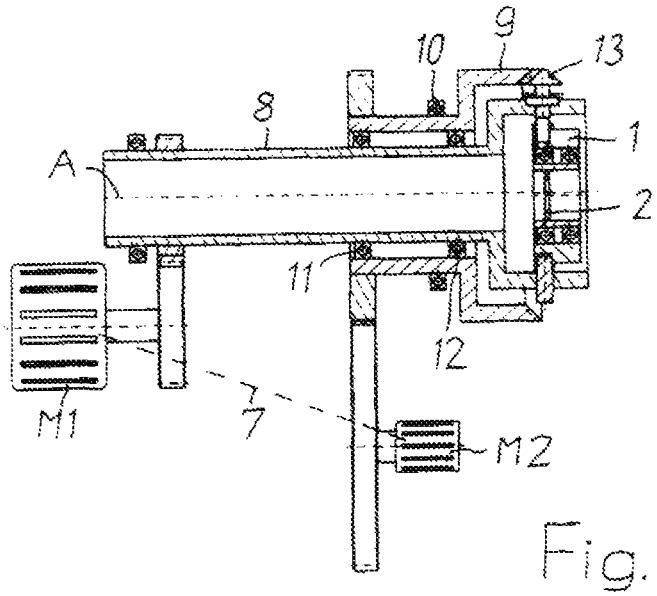
FIG. 2 shows the device in a more precise illustration.
Figure 3:
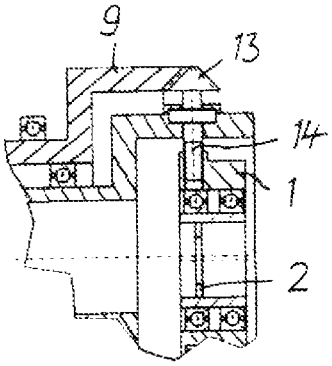
FIG. 3 shows, on a larger scale, an adjusting mechanism usable in the device.

Additional details of the device can be seen from the more detailed illustration in FIG. 2. Thus, the corrugation head 1 with corrugation disc 2 is connected to a hollow shaft 8 which is rotated during the operation of the device by the motor M1 about the axis A. The hollow shaft 8 has at one of its ends a widened portion for receiving the corrugation head 1. In this case, the support 5 is also constructed as a hollow shall 9 with a widened portion engaging around the widened portion of the hollow shaft 8. Within the device, the widened portion is mounted in a schematically illustrated bearing 10, and on the hollow shaft 8 through bearings 11 and 12.

In accordance with FIG. 2, the adjusting mechanism 6 can be equipped with a bevel wheel 13 with which the hollow shaft 9 is engaged at the end of its widened portion. In accordance with FIG. 3, the bevel wheel 13 is seated on a threaded rod 14 which is rotatably mounted in the corrugation head 1, and is connected to the corrugation disc 2. The bevel wheel 13 is advantageously a gear wheel which meshes with the support 5 equipped with corresponding teeth. The adjusting mechanism 6 may also be of a construction which differs from those of the illustrated embodiments, as long as it is ensured that a change of the rotation of the support 5, or of the hollow shaft 9, leads to a radial adjustment of the corrugation disc 2. Accordingly, the support 5, or the hollow shaft can also be pushed in the axial direction for actuating the adjusting mechanism 6, with the rate of rotation of the support 5 being unchanged.

The invention claimed is:

1. A device for corrugating a metal pipe, which, as a finished product, has a corrugation extending transversely of a longitudinal direction of said pipe, said device comprising:

a ring-shaped corrugating head which is drivable by a first electric motor and is rotatable, in an operating position, about the longitudinal axis of a pulling direction of said metal pipe; and a ring-shaped corrugation disc, coupled to said ring-shaped corrugating head, projects radially inwardly from the corrugation head, wherein the ring-shaped corrugation disc is mounted in the ring-shaped corrugation head so as to be adjustable in the radial direction, wherein in the area of the ring-shaped corrugation head, a support, that is coupled to the ring-shaped corrugation head, is arranged so as to also be rotatable about the axis of the corrugation head, wherein an adjusting mechanism acting on the ring-shaped corrugation disc is mounted on the ring-shaped corrugation head for adjusting the corrugation without interrupting the operation of said device, wherein the adjusting mechanism serves for radially adjusting the ring-shaped corrugation disc to maintain consistent corrugation depth and is adjustable by the support, and wherein the support is connected to a second electric motor rotating the support about said axis of the corrugation head, a rate of rotation of the second electric motor being temporarily increased or decreased by a signal from a controlling unit, which measures the corrugations for proper depth, said controlling unit and second motor acting to rotate the support in a manner that adjusts the corrugation disc to maintain consistent depth of corrugation.

2. The device according to claim 1, wherein the first electric motor and the second electric motor are connected to each other by an electric shaft.

3. The device according to claim 1, wherein the support is constructed as a hollow shaft.

4. The device according to claim 1, wherein the adjusting mechanism includes a bevel wheel adjustable by the support.

* * * * *